US007370383B1

(12) United States Patent
Chinowsky Wink

(10) Patent No.: US 7,370,383 B1
(45) Date of Patent: May 13, 2008

(54) BRUSH DEVICE

(76) Inventor: Debra L. Chinowsky Wink, 2033 Port Weybridge Pl., Newport Beach, CA (US)

( * ) Notice: Subject to any disclaimer, the term of this patent is extended or adjusted under 35 U.S.C. 154(b) by 0 days.

(21) Appl. No.: 11/420,518

(22) Filed: May 26, 2006

(51) Int. Cl.
*A46B 15/00* (2006.01)
*A46B 17/04* (2006.01)
*A47L 17/00* (2006.01)

(52) U.S. Cl. ..... 15/164; 15/144.4; 15/184; 206/361; 206/362.2

(58) Field of Classification Search ..... 15/144.4, 15/164, 184, 211; 206/361, 362.2, 362.3, 206/15.2, 15.3
See application file for complete search history.

(56) References Cited

U.S. PATENT DOCUMENTS 2,228,067 A * 1/1941 Von Den Driesch ..... 15/164
3,088,150 A * 5/1963 Sweeney ..... 15/106
3,862,461 A 1/1975 Bucklitzsch
D250,068 S 10/1978 Ducotey
4,502,176 A 3/1985 Wallace
5,033,155 A * 7/1991 Klotz ..... 15/211
5,608,938 A 3/1997 Baschenis
6,558,061 B2 5/2003 Petit
6,892,416 B2 5/2005 Lee et al.
7,017,222 B2 * 3/2006 Dunn ..... 15/106
2004/0060837 A1 4/2004 Rogers et al.
2005/0066457 A1 * 3/2005 McKay ..... 15/23

FOREIGN PATENT DOCUMENTS

DE 3330488 * 3/1985

* cited by examiner

*Primary Examiner*—Mark Spisich

(57) ABSTRACT

A brush device for cleaning an interior of a bottle includes a shaft being insertable into an interior of a bottle. Each of a plurality of bristle sets is coupled to the shaft and is positioned adjacent an end of the shaft. Each of the bristle sets is insertable into the interior of the bottle to scrub the bottle. A handle is coupled to an end of the shaft distal to the bristle sets. The handle is graspable to facilitate manipulation of the shaft and the bristle sets to scrub the interior of the bottle.

1 Claim, 5 Drawing Sheets

BRUSH DEVICE

BACKGROUND OF THE INVENTION

1. Field of the Invention

The present invention relates to baby bottle brushes and more particularly pertains to a new baby bottle brush for cleaning an interior of a bottle.

2. Description of the Prior Art

The use of baby bottle brushes is known in the prior art. The prior art commonly teaches a brush coupled to a cap that is inserted into a baby bottle to scrub an interior of the baby bottle.

While these devices fulfill their respective, particular objectives and requirements, the need remains for a device that has certain improved features that allow for a length of the device to be adjusted to accommodate bottles of the different sizes. Additionally, the device has a cover for protecting the device from being damaged when not being used to clean a bottle.

SUMMARY OF THE INVENTION

The present invention meets the needs presented above by generally comprising a shaft being insertable into an interior of a bottle. Each of a plurality of bristle sets is coupled to the shaft and is positioned adjacent an end of the shaft. Each of the bristle sets is insertable into the interior of the bottle to scrub the bottle. A handle is coupled to an end of the shaft distal to the bristle sets. The handle is graspable to facilitate manipulation of the shaft and the bristle sets to scrub the interior of the bottle.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
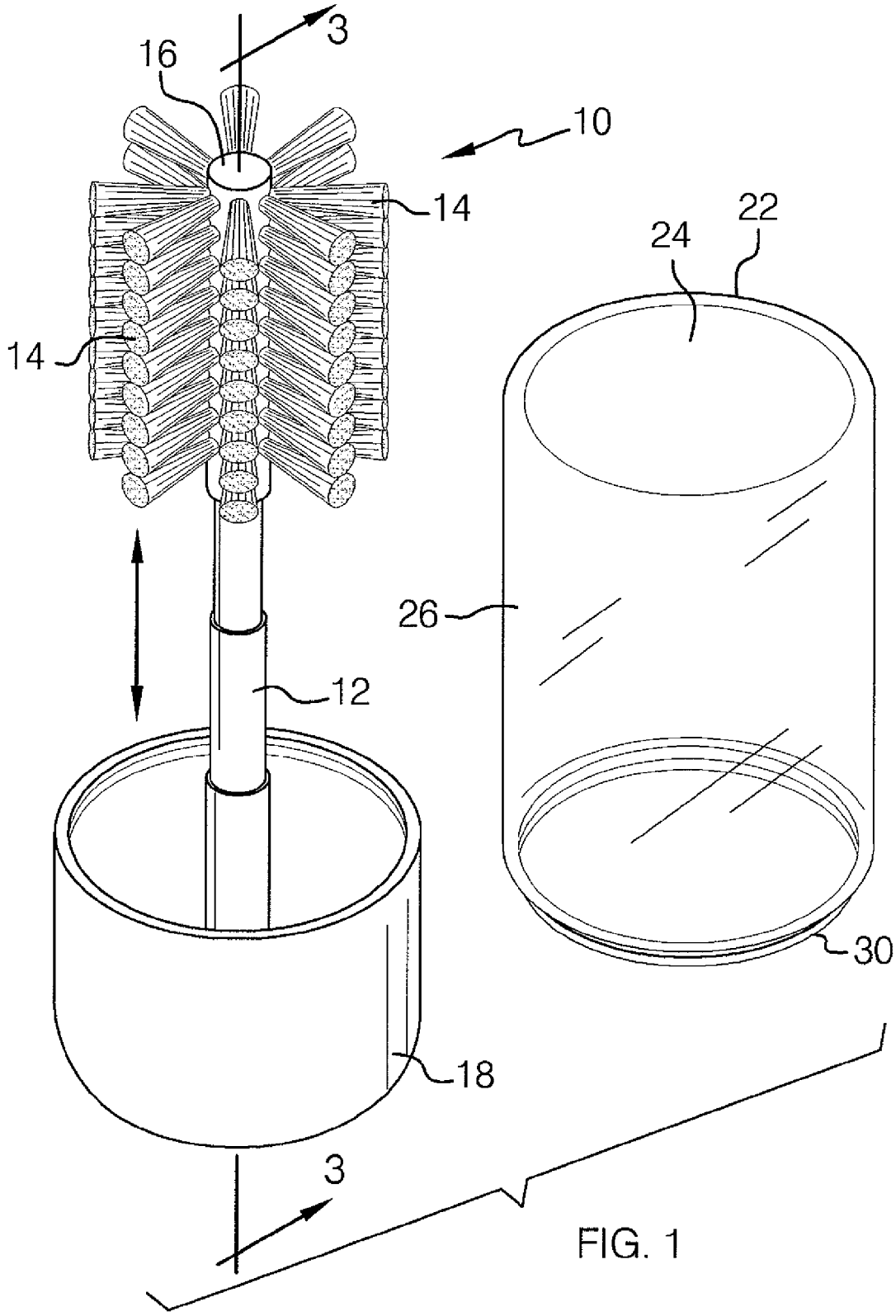
FIG. 1 is an exploded perspective view of a brush device according to the present invention.
Figure 2:
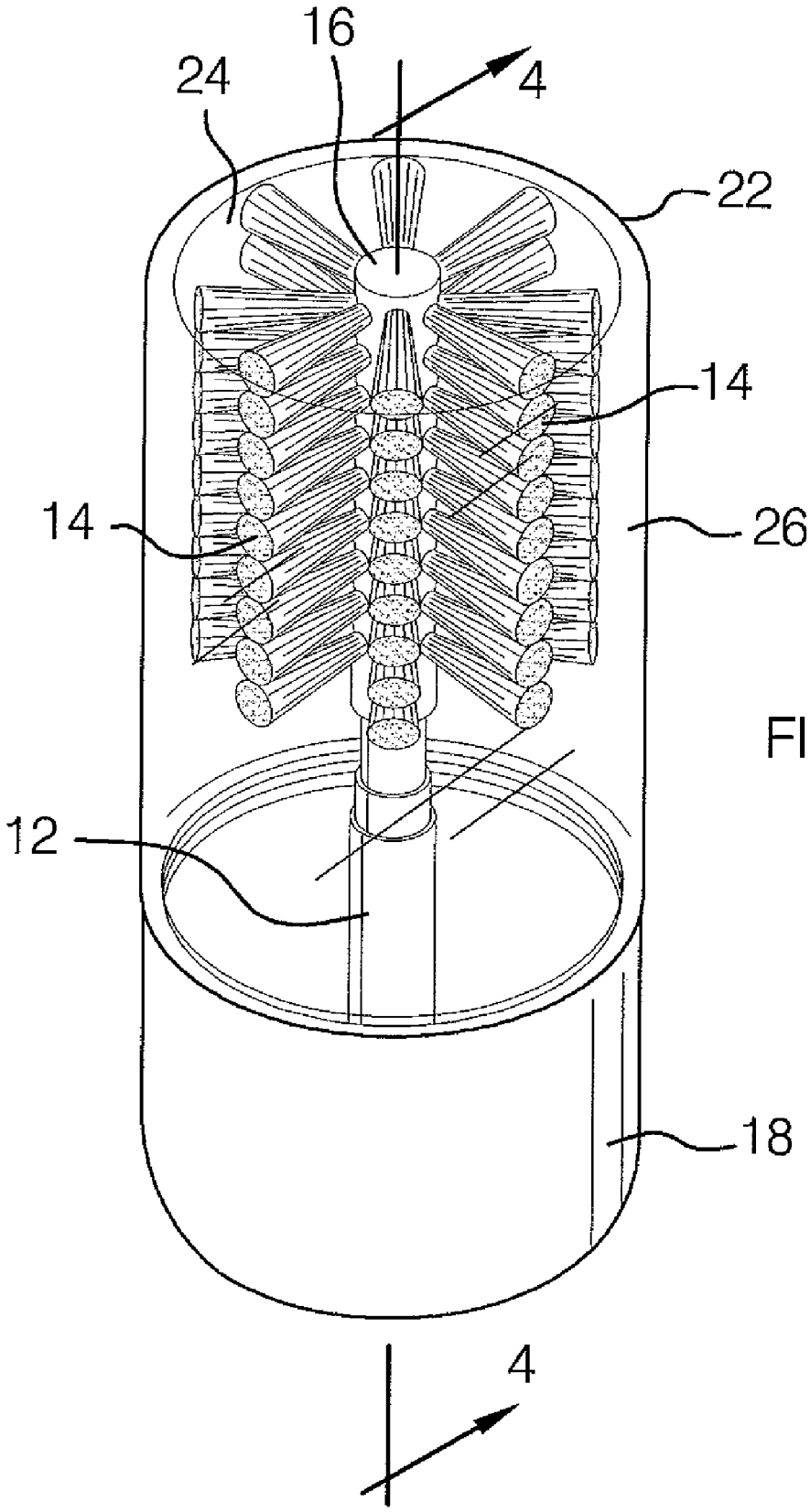
FIG. 2 is a perspective view of the present invention.
Figure 3:
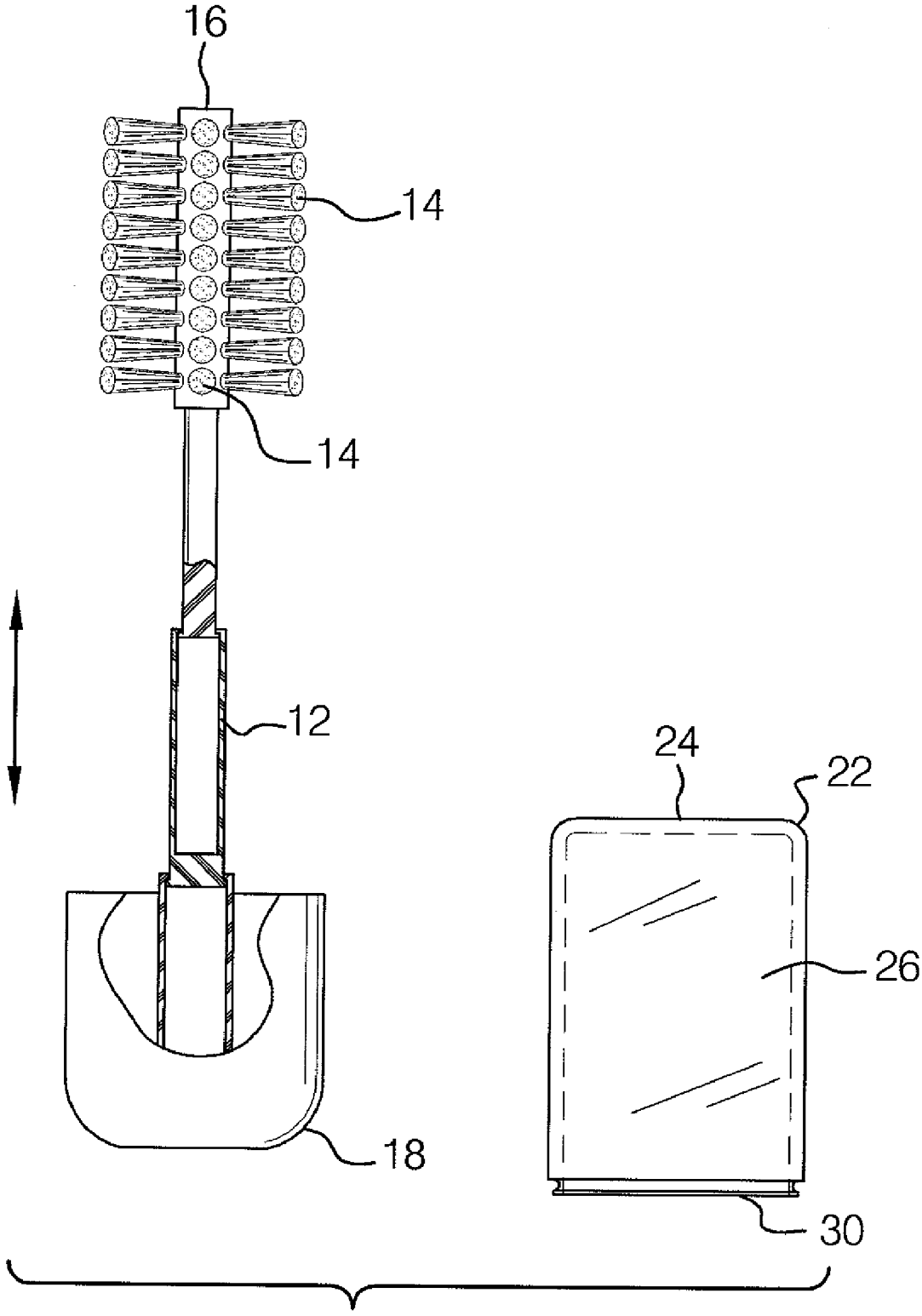
FIG. 3 is an exploded partial cross-sectional side view of the present invention taken along line 3-3 of FIG. 1.
Figure 4:
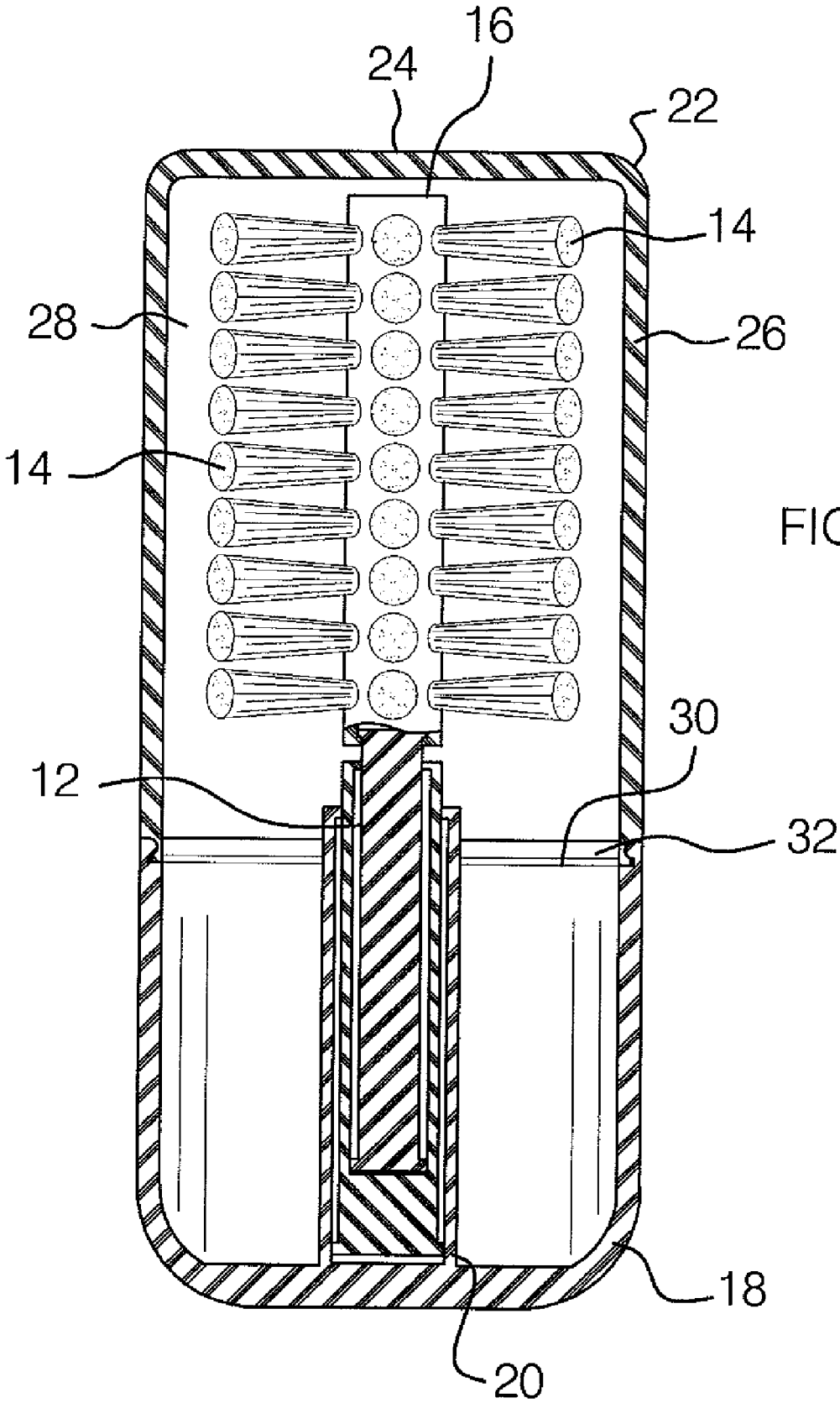
FIG. 4 is a cross-sectional view of the present invention taken along line 4-4 of FIG. 2.
Figure 5:
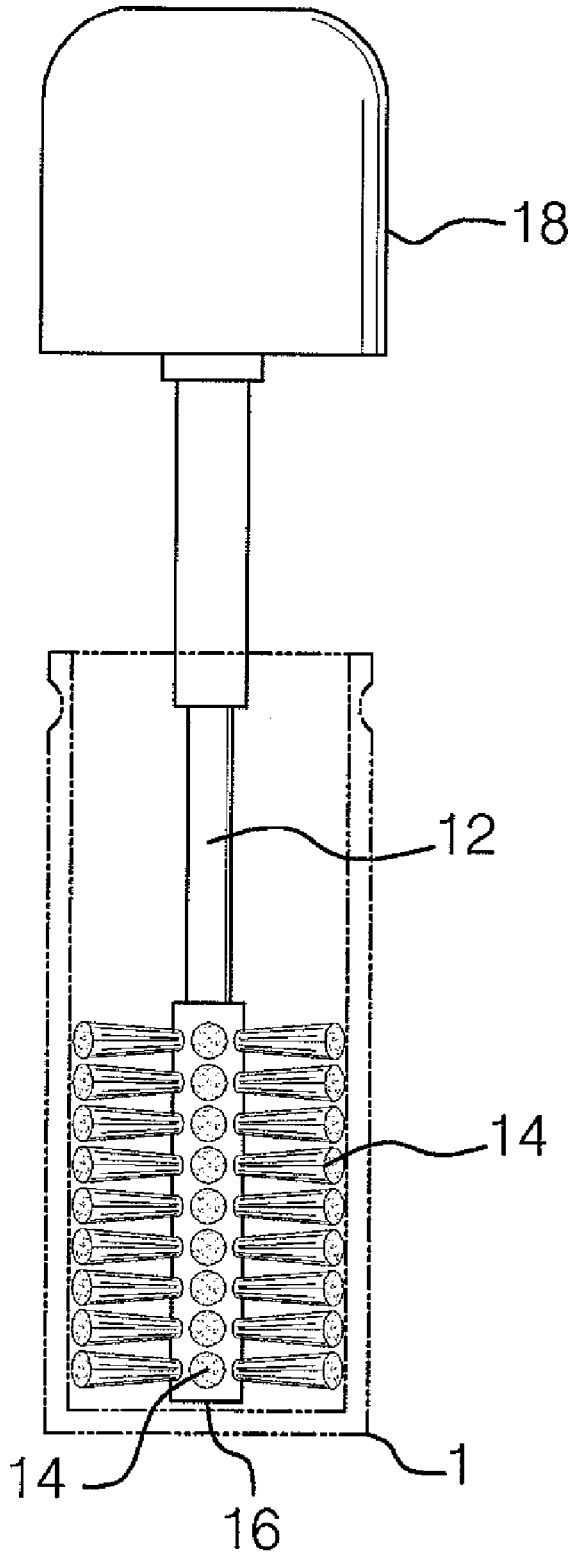
FIG. 5 is a side view of the present invention shown in use.

With reference now to the drawings, and in particular to FIGS. 1 through 5 thereof, a new baby bottle brush embodying the principles and concepts of the present invention and generally designated by the reference numeral 10 will be described.

As best illustrated in FIGS. 1 through 5, the brush device 10 generally comprises a shaft 12 being insertable into an interior of a bottle 1, such as a baby bottle. The shaft 12 is telescopic to permit selective adjustment of a length of the shaft 12. Each of a plurality of bristle sets 14 is coupled to the shaft 12 and is positioned adjacent an end 16 of the shaft 12. Each of the bristle sets 14 is insertable into the interior of the bottle 1 to scrub the bottle 1. Each of the bristle sets 14 has a substantially frusto-conical configuration and widens as it extends from the shaft 12. Each of the bristle sets 14 extends substantially radially from the shaft 12 and is positioned substantially orthogonally to the shaft 12.

A handle 18 is coupled to an end 20 of the shaft 12 distal to the bristle sets 14. The handle 18 is graspable to facilitate manipulation of the shaft 12 and the bristle sets 14 to scrub the interior of the bottle 1. The handle 18 has a substantially cylindrical configuration. A cover 22 is selectively extended over the bristle sets 14 to inhibit the bristles sets being damaged when not in use. The cover 22 selectively engages the handle 18 to cover 22 the shaft 12 and the bristle sets 14. The cover 22 includes a bottom wall 24 and a perimeter wall 26 coupled to and extending orthogonally to the bottom wall 24 to define an interior space 28 of the cover 22. A terminal edge 30 of the perimeter wall 26 opposite the bottom wall 24 defines an open end 32 to permit the shaft 12 and the bristle sets 14 to be inserted into the interior space 28 of the cover 22. The terminal edge 30 is threaded to threadably engage the handle 18. The cover 22 is comprised of a transparent material. The cover 22 has a substantially cylindrical configuration.

In use, the cover 22 is removed from the handle 18 and the shaft 12 and bristles sets are withdrawn from the cover 22. The shaft 12 is extended to a desired length. The bristle sets 14 are then inserted into the interior of the bottle 1 to scrub the interior of the bottle 1. When the bottle 1 is scrubbed the shaft 12 and bristle sets 14 are removed from the bottle 1 and the shaft 12 is collapsed. The cover 22 is replaced over the bristles sets and the shaft 12 and threaded to the handle 18 to protect the bristle sets 14.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A brush device for scrubbing an interior of a bottle, said device comprising:

a shaft being insertable into the interior of the bottle, said shaft being telescopic to permit selective adjustment of a length of said shaft;

a plurality of bristle sets, each of said bristle sets being coupled to said shaft and being positioned adjacent an end of said shaft, each of said bristle sets being insertable into the interior of the bottle to scrub the bottle, each of said bristle sets having a substantially frusto-conical configuration and widening outwardly from said shaft, each of said bristle sets extending substantially radially from said shaft and positioned substantially orthogonally to said shaft;

a handle being coupled to an end of said shaft distal to said bristle sets, said handle being graspable to facilitate manipulation of said shaft and said bristle sets to scrub the interior of the bottle, said handle having a substantially cylindrical configuration; and a cover being selectively extended over said bristle sets to inhibit said bristles sets being damaged when not in use, said cover selectively engaging said handle to cover said shaft and said bristle sets, said cover including a bottom wall and a perimeter wall being coupled to and extending orthogonally to said bottom wall to define an interior space of said cover, a terminal edge of said perimeter wall opposite said bottom wall defining an open end to permit said shaft and said bristle sets to be inserted into said interior space of said cover, said terminal edge being threaded to threadably engage said handle, said cover being comprised of a transparent material, said cover having a substantially cylindrical configuration.

* * * * *